US005853504A

United States Patent [19]

Nishimura

[11] Patent Number: 5,853,504

[45] Date of Patent: Dec. 29, 1998

[54] MATERIAL FOR LAPPING TOOLS AND LAPPING SURFACE PLATE USING THE SAME

[75] Inventor: Takanobu Nishimura, Chigasaki, Japan

[73] Assignee: Kabushiki Kaisha Toshiba, Kawasaki, Japan

[21] Appl. No.: 919,220

[22] Filed: Aug. 28, 1997

[30] Foreign Application Priority Data

Sep. 5, 1996 [JP] Japan ..... 8-235512

[51] Int. Cl.[6] ..... C22C 37/04

[52] U.S. Cl. ..... 148/324; 420/10; 420/27

[58] Field of Search ..... 148/324; 420/10, 420/27

[56] References Cited

U.S. PATENT DOCUMENTS

| | | | |
|---|---|---|---|
| 1,900,125 | 3/1933 | Merica et al. . | |
| 3,702,269 | 11/1972 | Church | 420/27 |
| 3,902,897 | 9/1975 | Sobue et al. | 420/27 |
| 4,867,803 | 9/1989 | Shikata et al. . | |
| 5,041,173 | 8/1991 | Shikata et al. . | |

FOREIGN PATENT DOCUMENTS

| | | | |
|---|---|---|---|
| 2509327 | 1/1983 | France | 148/321 |
| 360772 | 2/1931 | United Kingdom | 420/27 |

OTHER PUBLICATIONS

O. Haruyasu, "Lapping Surface Plate of High Function", Patent Abstract of Japan, vol. 97, No. 6, of JP 09 029623 (Jun. 1997).

T. Masaharu, "Surface Plate for Polishing," Patent Abstract of Japan, vol. 96, No. 11, of JP 08 174407 (Nov. 1996).

*Primary Examiner*—Deborah Yee

*Attorney, Agent, or Firm*—Finnegan, Henderson, Farabow, Garrett & Dunner, L.L.P.

[57] ABSTRACT

A lapping surface plate consisting of an Fe-base material containing 0.8 to 3.5 wt % of C, 1 to 7 wt % of Si, 5 to 15 wt % of Ni, and 1 wt % or less of Mn, the balance substantially being Fe, further containing 0.1 wt % or less of at least one element selected from the group consisting of Mg, Ca, and Ce, and having a graphite structure and a hardness of 250 Hv or more.

11 Claims, 3 Drawing Sheets

MATERIAL FOR LAPPING TOOLS AND LAPPING SURFACE PLATE USING THE SAME

BACKGROUND OF THE INVENTION

1. Field of the Invention

The present invention relates to a material for lapping tools used for lapping semiconductor substrates such as silicon wafers, oxide monocrystal substrates, quartz glass etc. and a lapping surface plate using the material.

2. Description of the Related Art

Conventionally, in the lapping operation of semiconductor substrates such as silicon wafers, GaAs, and InP, oxide monocrystal substrates such as $LiTaO_3$, quartz photomasks, and the like, a method is used in which abrasive particles (lapping agent) in the form of a slurry are supplied between the upper and lower surface plates and a workpiece, and a necessary amount of material to be lapped is removed from the workpiece by using cutting edges of abrasive particles and using the rotational motion of surface plates while applying a working pressure, thereby the flatness of the surface plates being transfer-printed onto the workpiece.

Such a lapping operation is often used to flatten the surface of not only silicon wafer and the like but also a workpiece of glass, jewels, metals, and ceramics. Especially in recent years, for semiconductor substrates such as silicon wafers and the like, flatness has been demanded more and more strictly with a sudden increase in the degree of integration, so that the maintenance of flatness of surface plate used for lapping has become important.

A lapping surface plate for silicon wafers is abraded by the abrasive particles in the same manner as the silicon wafer. The distribution of abrasive particles and the angular velocity of rotation are increased at the outer periphery of the surface plate by the rotation of surface plate, so that the abrasion amount increases at the outer periphery of lower surface plate. That is to say, the flatness of surface plate changes as the lapping operation time elapses, and the lapping surface of lower surface plate has a tendency to change so as to be convex upward.

Thus, the flatness of lapping surface plate has a tendency to change with the elapse of the lapping operation time. On the other hand, as the demand for flatness of silicon wafer etc. increases as described above, the requirement that the change of flatness of lapping surface plate is kept small has presented an important technical problem. Therefore, the common sense of the lapping surface plate for silicon wafers is overthrown, and a lapping surface plate made of a material with a hardness of 200 Hv and more has been proposed (U.S. Pat. No. : 4,867,803, U.S. Pat. No.: 5,041,173), and practically used for lapping silicon wafers.

For the lapping surface plate of high hardness as described above, a material has been practically used which is controlled so as to have a hard structure (martensite structure, bainite structure, pearlite structure, etc.) by quenching or rapidly cooling a matrix structure of cast iron base material after solution treatment such as quenching, tempering, austempering, and normalizing.

On the other hand, the size of a silicon wafer is mainly 8 inches (about 203 mm) in outside diameter, and a wafer with an outside diameter of 12 inches or more is now being developed. With increasing diameter of silicon wafer, the lapping surface plate has a tendency to become larger, the standard diameter thereof being 1.5 to 2.0 m (thickness: 40 to 60 mm).

As described above, the hard lapping surface plate with a hardness of 200 Hv or more is effective in keeping the change of flatness small. Therefore, for a large lapping surface plate as well, it has been expected that the change of flatness is kept small by high hardness of 200 Hv or more.

However, for such a large lapping surface plate, if the quenching or rapid cooling treatment with a high cooling rate is performed to obtain a hard structure as described above, new problems arise in that the deformation becomes remarkable, the structure becomes inhomogeneous, and so on.

Thus, for the lapping surface plate made large with increasing diameter of semiconductor wafer, it has become difficult to restrain the deformation or make the structure homogeneous by quenching or rapid cooling treatment for obtaining the aforesaid hardness.

For this reason, the achievement of high hardness in the especially large lapping surface plate without quenching or rapid cooling treatment is a problem.

On the other hand, the material for surface plate for lapping semiconductor wafers is required to be free of hard precipitates such as coarse carbide causing scratches of wafer and to have a highly uniform hardness.

SUMMARY OF THE INVENTION

The present invention was made to solve the above problems, and accordingly an object thereof is to provide a material for lapping tools, which achieves a high hardness of 250 Hv or more without quenching or rapid cooling treatment, and a lapping surface plate using the material, and further to provide a material for lapping tools free from hard precipitates and having a highly uniform hardness and a lapping surface plate using the material.

The material for lapping tools in accordance with the present invention consists of an Fe-base material containing 0.8 to 3.5 wt % of C, 1 to 7 wt % of Si, 5 to 15 wt % of Ni, and 1 wt % or less of Mn, the Fe-base material having a graphite structure and a hardness of 250 Hv or more.

Also, the Fe-base material further contains 0.1 wt % or less of at least one element selected from the group consisting of Mg, Ca, and Ce.

The lapping surface plate in accordance with the present invention consists of an Fe-base material containing 0.8 to 3.5 wt % of C, 1 to 7 wt % of Si, 5 to 15 wt % of Ni, and 1 wt % or less of Mn, the Fe-base material having a graphite structure and a hardness of 250 Hv or more.

Also, the aforesaid lapping surface plate is characterized in that the Fe-base material further contains 0.1 wt % or less of at least one element selected from the group consisting of Mg, Ca, and Ce in addition to the above-mentioned metals.

Also, the lapping surface plate has a metallographic structure comprising a martensite structure of an area ratio of 30% or more, a graphite spheroidization percentage of 70% or more, and a hardness of 250 Hv or more.

The Fe-base material for lapping tools in accordance with the present invention has a composition containing Ni of a relatively high concentration as a base, has a composition in which the martensite structure emerges in a state of as cast structure, and has a carbon content structure in which a graphite structure emerges, so that it achieves a hardness as high as 250 Hv or more without quenching or rapid cooling treatment.

Accordingly, it becomes possible to eliminate the deformation and inhomogeneous structure caused by quenching or rapid cooling treatment, so that even for a large lapping surface plate, improved shape accuracy and uniform hardness can be achieved. Also, the capture site of lapping abrasive particles etc. can be provided by a graphite structure, and the lapping workability of semiconductor substrate etc. can be provided sufficiently.

The following is a description of a mode for carrying out the present invention.

The material for lapping tools in accordance with the present invention basically consists of an Fe-base material containing 0.8 to 3.5 wt % of C, 1 to 7 wt % of Si, 5 to 15 wt % of Ni, and 1 wt % or less of Mn, further containing 0.1 wt % or less of at least one element selected from the group consisting of Mg, Ca, and Ce as necessary, the balance substantially being Fe, and having a graphite structure.

The material for lapping tools consisting of the aforesaid Fe-base material has a graphite structure of spheroidal graphite, pseudo-spheroidal graphite, flake graphite, eutectic graphite, etc. which provides the capture site of lapping abrasive particles, and has a composition in which the martensite structure emerges in the metallographic structure in a state of as cast structure to achieve a hardness of 250 Hv or more without performing rapid cooling treatment (quenching etc.) from a temperature of, for example, 1073 K and higher. The following is a description of the details of the composition of Fe-base material.

C (carbon) is an element for obtaining a high strength and high hardness of the Fe-base material, and an indispensable element for making a graphite structure emerge. As shown in FIG. 1, C content of 0.8 wt % or more can make a graphite structure emerge.

However, if C content exceeds 3.5 wt %, the spheroidal graphite gets out of shape, and the spheroidization percentage decreases. Therefore, C content is set to 3.5 wt % or less. The graphite structure based on this C provides the capture site of lapping abrasive particles as described before, and according to the composition of Fe-base material of the present invention, the graphite structure can be obtained in a state of as cast structure. A preferable content of C is in the range of 1.5 to 2.6 wt %.

Si (silicon) contributes to the improvement in the casting property, and serves as a graphitization accelerating element. To achieve these effects, Si content is set to 1.0 wt % or more. However, if the material contains 7.0 wt % or more of Si, Si reacts with Fe, Ni, and other elements to yield an intermetallic compound ($M_3Si$: M is Fe, Ni, etc.), resulting in a decrease in the mechanical properties such as hardness and strength. Therefore, in the present invention, Si content is in the range of 1.0 to 7.0 wt %, preferably in the range of 2.0 to 4.0 wt %.

Ni forms solid solution with Fe up to about 76 wt % in a wide range, and as known in terms of Schaeffler's structure chart, the phase construction of matrix structure, for example, the ratio of martensite structure to austenite structure is determined from the relationship between Ni content (equivalent) and Cr content (equivalent) in Fe. The Ni equivalent and Cr equivalent in Schaeffler's structure chart are expressed by the following equation.

However, in the actual as cast structure, there is a tendency for the zone of martensite structure to slightly expand from Schaeffler's structure chart due to segregation etc. caused in solidification.

Ni equivalent (wt %)=Ni wt %+30×C wt %+0.5×Mn wt % Cr equivalent (wt %)=Cr wt %+1.5×Si wt %+Mo wt % where C wt % indicates solution carbon content.

As seen from FIG. 2, the Fe-base material used as the material for lapping tools in accordance with the present invention contains, considering C content, Si content, later-described Mn content, etc., Ni amount that can make the martensite structure emerge in the metallographic structure in a state of as cast structure, that is, contains 5.0 to 15.0wt % of Ni. The martensite structure, having a high hardness, can achieve a hardness as high as 250 Hv or more.

Mn has an effect of improving the mechanical strength. However, if the content thereof is too high, the formation of carbide cannot be avoided. Mn also serves as a austenitizing element. Therefore, the upper limit of Mn content is set to 1.0 wt %. Even if a small amount is added, Mn achieves an effect corresponding to the added amount, so that Mn content is in the range of 0 to 1.0 wt % (excluding 0).

At least one element selected from Mg, Ca, and Ce, being an additional element to make the graphite structure spheroidal or pseudo-spheroidal, is added as necessary. If added amount of these elements exceeds 0.1 wt %, there is a possibility that the compound of these elements precipitates. Therefore, the content is set to 0.1 wt % or less.

Although the material for lapping tools in accordance with the present invention is based on the aforementioned Fe-base material composition, it may contain 2.0 wt % or less of Cr, Mo, Nb, Ti, V, Cu, etc. unless the range of content is such that a coarse hard precipitate with a particle diameter of 20 $\mu$m and larger is formed. In particular, Cr contributes to the improvement in corrosion resistance, etc., but may precipitate as Cr carbide, and exerts an influence upon the metallographic structure of Fe-base material. Therefore, the content must be determined in consideration of these facts, and Cr content is set to 2.0 wt % or less.

As described above, the material for lapping tools in accordance with the present invention has a matrix structure that makes the martensite structure emerge in a state of as cast structure, and achieves a hardness of 250 Hv or more even in the as cast structure without quenching or rapid cooling treatment. Thus, by achieving a hardness of 250 Hv or more in the as cast structure, problems of deformation and inhomogeneous structure caused by quenching or rapid cooling treatment can be avoided.

Preferably, the composition of components and the performance of later-described heat treatment are determined so that the area ratio of the martensite structure in the metallographic structure is 30% or more. More preferably, the percentage of area accounted for by the martensite structure is 60% or more.

That is to say, 30% (area ratio) or more of matrix structure is made the martensite structure by setting proper Ni equivalent and Cr equivalent, by which the hardness (wear resistance), rigidity (modulus of elasticity), etc. can be increased as compared with the Fe-base material consisting mainly of austenite structure exceeding 70%, so that a hardness of 250 Hv or more can be achieved with high reproducibility.

As described later, the martensite structure is increased by decomposing the retained austenite structure by annealing and tempering after casting. Also, the martensite structure has a lower coefficient of thermal expansion than that of the austenite structure, so that it provides a low thermal expansion property. Therefore, the martensite structure also contributes to the restraint on thermal deformation of material for lapping tools.

When the material for lapping tools in accordance with the present invention is utilized for a lapping surface plate, the restraint on thermal deformation leads to the improvement in lapping accuracy.

The Fe-base material having the aforesaid composition sometimes has some retained austenite structure in a state of as cast structure. This retained austenite structure, like graphite, sometimes functions as the capture site of abrasive particles when being used for a lapping surface plate, contributing to the improvement in working speed. However, for example, in the lapping of semiconductor substrates, burrs produced from the surface plate when the working pressure is set high sometimes pose a problem.

In such a case, the material for lapping tools consisting of the aforesaid Fe-base material, specifically, the lapping surface plate made of this material is once subjected to solution treatment at a temperature of 1073 to 1223 K after casting, and then subjected to annealing treatment to be cooled to room temperature at a cooling rate of not more than air cooling rate, or the as cast material is tempered at a temperature of 573 to 973 K, by which the martensite structure without retained austenite structure can be obtained.

Because the elongation of martensite structure is almost zero, the occurrence of burrs of surface plate and continuous lapping chips can be inhibited, so that the occurrence of scratches on the surface of workpiece can be prevented.

The aforementioned annealing and tempering treatments, being effective in controlling the hardness and making the structure, strain, etc. homogeneous, are performed as necessary. For example, for the material for lapping tools in accordance with the present invention, the hardness becomes too high in a state of as cast structure depending on the composition, so that the workability of the material itself sometimes decreases.

In such a case, a relatively less hard as cast material with a hardness of 400 Hv or less is selected, worked at the stage of as cast material, and then is subjected to tempering treatment, by which a hard material exceeding 400 Hv and further a material with a hardness of 500 Hv or more can be obtained by the secondary hardening.

A special specification of lapping surface plate sometimes requires a hardness of 500 Hv or more. Such a requirement for high hardness can be met by the aforesaid tempering treatment in addition to the facilitated working of the later-described lattice-form grooves.

Also, the material for lapping tools in accordance with the present invention has a graphite structure in a state of as cast structure as described above. This graphite structure can be any of spheroidal graphite, pseudo-spheroidal graphite, flake graphite, eutectic graphite, etc. as described above. However, the spheroidal graphite is preferable when the material is used for the lapping operation of semiconductor substrates such as silicon wafers, and specifically a graphite spheroidization percentage of 70% or more is preferable.

In the recent lapping operation of silicon wafers etc., the spheroidal graphite structure is used in most cases, while the flake graphite or eutectic graphite is used for lapping jewels such as diamond. Thus, the graphite structure suitable for the surface plate differs depending on the workpiece, but a desired graphite structure can be obtained by controlling at least one element selected from Mg, Ca, and Ce in the range of 0.1 wt % or less.

The aforementioned material for lapping tools is used as a material for constituting, for example, a lapping surface plate. FIGS. 3A and 3B show a construction of a lapping surface plate in accordance with one embodiment of the present invention. A surface plate 1 shown in these figures is made of the aforesaid material for lapping tools in accordance with the present invention. The lapping surface plate 1 is formed with lattice-form grooves 2 on the surface (lapping surface) thereof, and provided with an abrasive particle supply hole 3 at the center thereof. The lattice-form grooves 2 are usually formed before the shape working of the lapping surface plate 1 is done in order to ensure the accuracy of the lapping surface.

Since the lapping surface plate of the this embodiment is made of the material for lapping tools in accordance with the present invention having a martensite structure in a state of as cast structure, it can achieve a hardness of 250 Hv or more without quenching or rapid cooling treatment. Therefore, even for a large lapping surface plate with a diameter of, for example, 1.2 to 2.0 m, problems of deformation and inhomogeneous structure caused by quenching or rapid cooling treatment can be solved.

The prevention of deformation caused by quenching or rapid cooling treatment contributes to the decrease in working cost for providing the shape of lapping surface plate, the long life due to the security of shape of lattice-form grooves 2, and so forth. Further, the manufacturing cost and manpower of the lapping surface plate 1 can be reduced because quenching or rapid cooling treatment is not done.

Also, since a hardness of 250 Hv or more is achieved without rapid cooling treatment, the structure and hardness of the lapping surface plate 1 can be made uniform. Further, since the lapping surface plate 1 has a composition that does not produce hard precipitates such as coarse carbide, the working accuracy of semiconductor substrate etc. can be enhanced, and the occurrence of scratches etc. can be prevented. The uniformity of structure and hardness can further be improved by performing tempering treatment etc.

The above-mentioned lapping surface plate 1 can be utilized for the surface working (surface flattening) of various workpieces of semiconductor substrates such as silicon wafers, GaAs, and InP, oxide monocrystal substrates such as $LiTaO_3$, quartz photomasks, glass, jewels, metals, and ceramics. In particular, it is utilized suitably for lapping silicon wafers whose diameter is now being increased.

The material for lapping tools in accordance with the present invention can be utilized effectively not only for a lapping surface plate but also as a constituting material for a correction jig for lapping surface plate, a fixing jig for workpiece, etc.

DESCRIPTION OF THE PREFERRED EMBODIMENTS

The following is a description of specific examples of the present invention.

EXAMPLE 1

Figure 1:
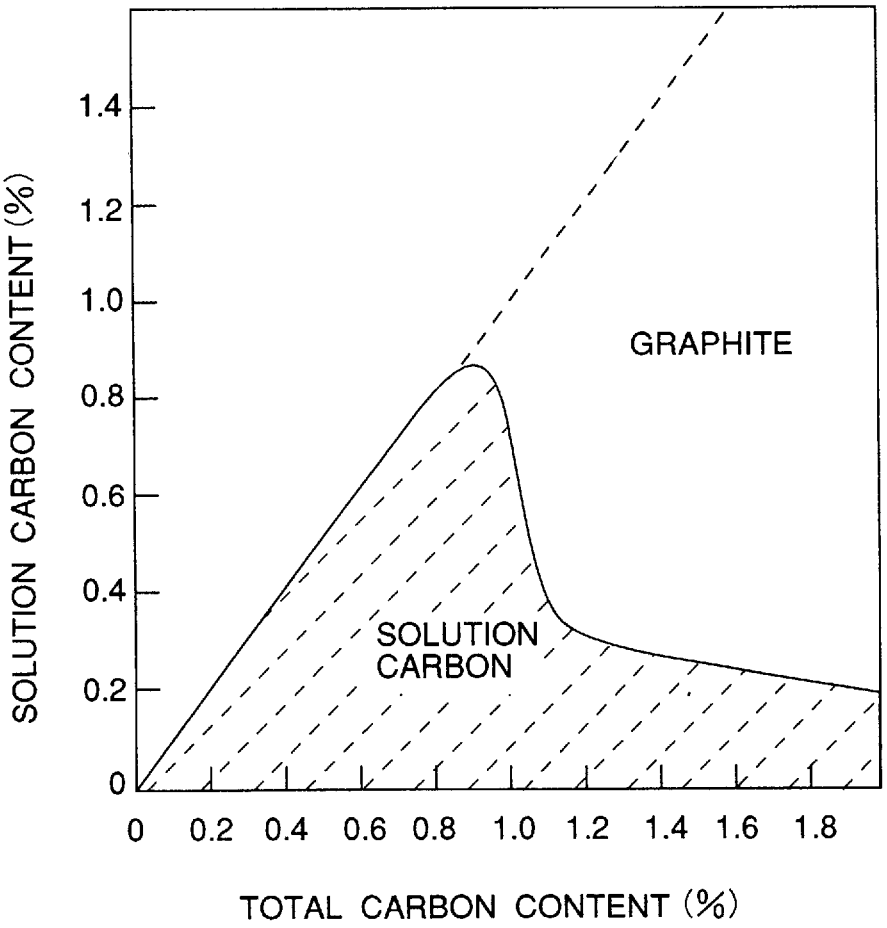
FIG. 1 is a diagram showing the relationship between total carbon content and solution carbon content in a Fe-base material.
Figure 2:
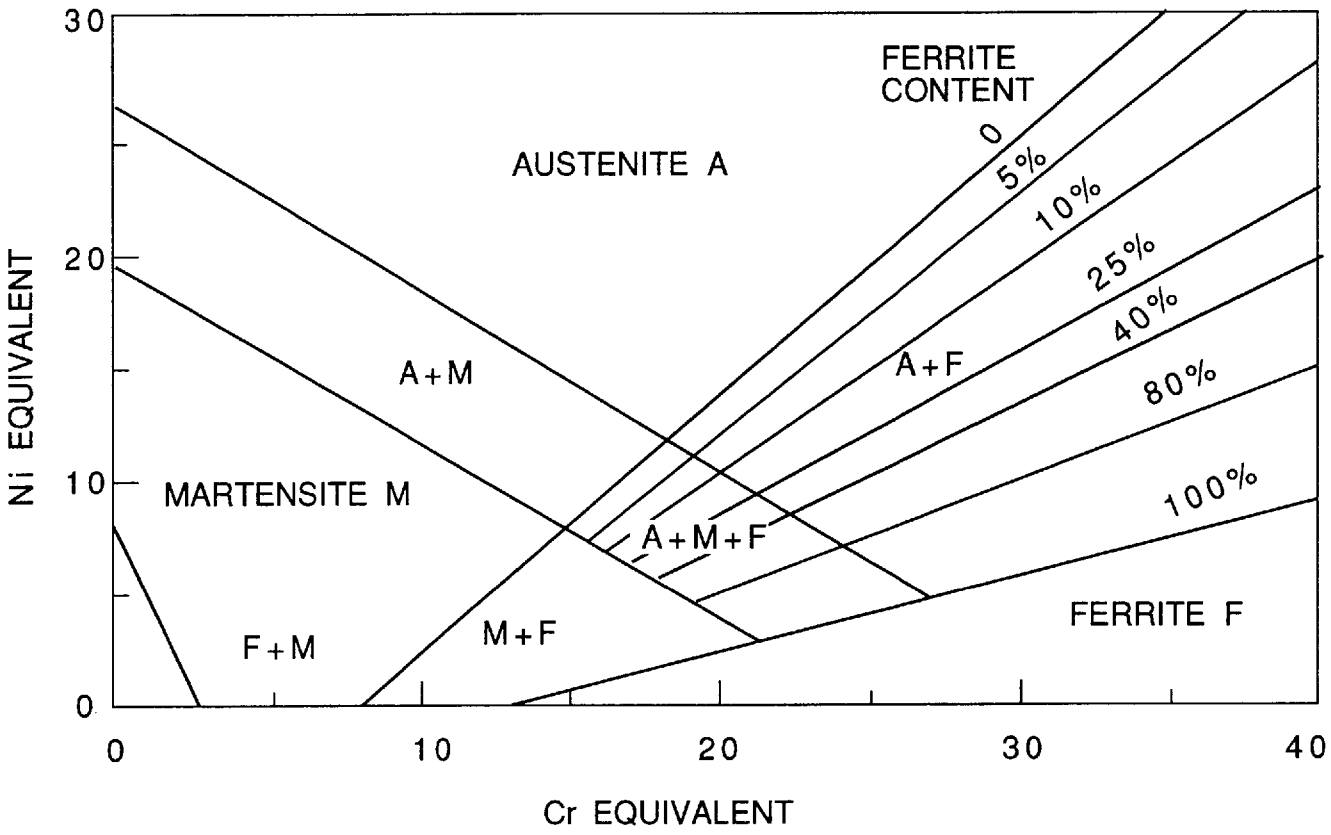
FIG. 2 is Schaeffler's structure chart showing phase structure in terms of Ni equivalent and Cr equivalent of a Fe-base material.
Figure 3A:
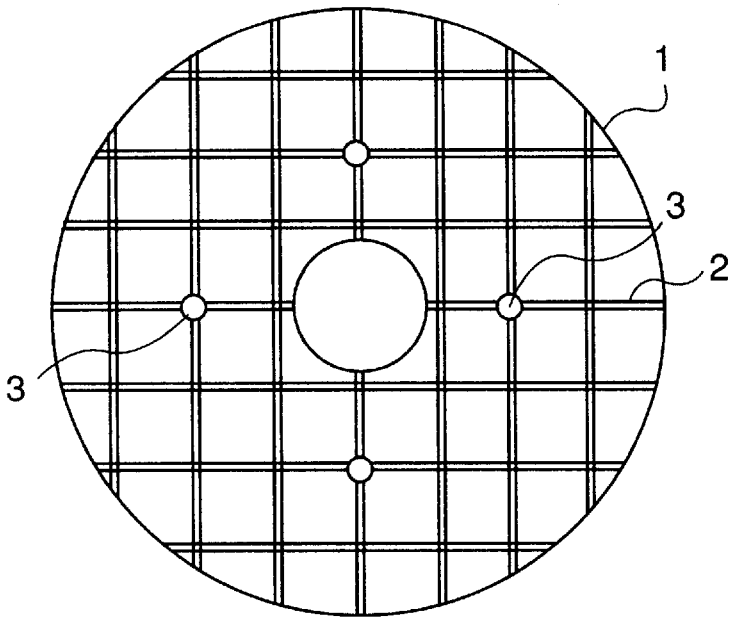
FIG. 3A is a plan view showing a construction of a lapping surface plate in accordance with one embodiment of the present invention.
Figure 3B:
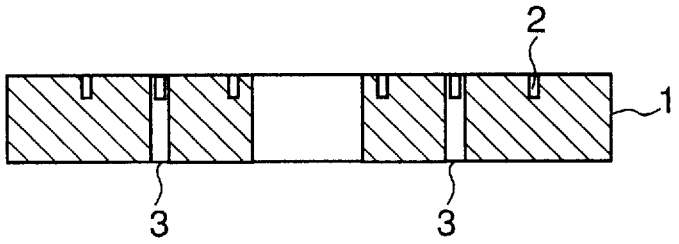
FIG. 3B is a sectional view in the radial direction of a lapping surface plate shown in FIG. 3A.

Spheroidal graphite cast iron whose composition is given in Table 1 is cast to manufacture a lapping surface plate 1, shown in FIGS. 3A and 3B, with an outside diameter of 1400 mm, an inside diameter of 400 mm, and a thickness of 60 mm in the casting dimensions. The working of surface plate shape and working of lattice-form grooves 2 with a width of 2 mm, a depth of 15 mm, and a formation pitch of 40 mm, abrasive particle supply holes 3 with a diameter of 8 mm, etc. were done in a state of as cast structure, and then tempering treatment was performed at a temperature of 673 K for four hours.

The above-mentioned lapping surface plate had a surface hardness of 280 Hv at the stage of as cast material, an area percentage of 30% accounted for by the martensite structure in the metallographic structure, and a graphite structure at the stage of as cast material. The hardness after tempering was substantially uniform in the depth direction and on the lapping surface, and a hardness of 450 Hv was obtained. The area percentage accounted for by the martensite structure after tempering was 90%, and the spheroidization percentage of graphite was about 80%. Thermal deformation due to tempering treatment scarcely occurred, and the lapping surface plate was finished into a flatness of 10 $\mu$m by lapping operation after tempering.

As control example 1 for comparison with the present invention, a lapping surface plate with a hardness of 450 Hv was manufactured by subjecting a cast iron material whose composition is given in Table 1 to quenching and tempering treatment. In this lapping surface plate as well, lattice-form grooves and abrasive particle supply holes having the same shape as that of the above-mentioned example were formed in a state of as cast structure like the example.

Each of the lapping surface plates of the above-mentioned example 1 and control example 1 was mounted on a lapping machine to carry out lapping operation (lapping abrasive particles: #1200) of an 8-inch silicon wafer. It was verified that the flatness accuracy of silicon wafer and the scratch occurrence amount showed the equivalent values, and the lapping surface plate of the above example 1 is by no means inferior to the conventional lapping surface plate (control example 1). However, the lapping surface plate of control example 1 subjected to quenching and tempering treatment had lattice-form grooves of a decreased depth because of thermal deformation in quenching, the depth of groove being about 8 mm. On the other hand, the lapping surface plate of example 1, the depth of 15 mm in working was maintained, and finally the life of lapping surface plate (number of wafers worked) was about 460,000 sheets, increasing by a factor of about 1.5 as compared with about 300,000 sheets of control example 1.

EXAMPLE 2

A lapping surface plate having the same shape as that of example 1 was manufactured by using cast iron whose composition is given in Table 1. For the composition of this example 2, although 2.0 wt % of carbon was contained to crystallize spheroidal graphite, coarse carbide particles with a particle diameter of 20 $\mu$m or more were not precipitated because 4.5 wt % of Si and 10 wt % of Ni, which are graphitization accelerating elements, were contained even though 0.8 wt % of Cr was added.

The above-mentioned lapping surface plate had a surface hardness of 430 Hv at the stage of as cast material, an area percentage of 85% accounted for by the martensite structure in the metallographic structure, and a spheroidization percentage of graphite of as cast material of about 90%. This lapping surface plate was mounted on a lapping machine similar to that of example 1 in a state of as cast material without tempering treatment etc. to carry out lapping operation (lapping abrasive particles: #1200) of an 8-inch silicon wafer. It was verified that the flatness accuracy of silicon wafer and the scratch occurrence amount showed values equivalent to those of example 1, and finally the life of lapping surface plate (number of wafers worked) was about 430,000 sheets, the lapping surface plate having characteristics equivalent to those of example 1.

TABLE 1

| Cast iron composition (wt %) | | | | | | | As cast material | | Heat-treated material | | |
|---|---|---|---|---|---|---|---|---|---|---|---|
| C | Si | Mn | Ni | Cr | Mg | Fe | Hardness (Hv) | Martensite phase area percentage (%) | Hardness (Hv) | Martensite phase area percentage (%) | Life of surface plate |
| | | | | | | | Example 1 | | | | |
| 1.5 | 2.5 | 0.6 | 15 | — | 0.05 | Balance | 280 | 30 | 450 | 90 | 460,000 sheets |
| | | | | | | | EExample 2 | | | | |
| 2.0 | 4.5 | 0.2 | 10 | 0.8 | 0.04 | Balance | 430 | 85 | — | — | 430,000 sheets |
| | | | | | | | Control example 1 | | | | |
| 2.5 | 2.8 | 0.5 | 2.0 | — | 0.05 | Balance | 240 | 0 | 450 | 100 | 300,000 sheets |

EXAMPLE 3

A lapping surface plate having the same shape as that of example 1 was manufactured by using cast iron whose composition is given in Table 2. For the composition of example 3, the hardness of the as cast material was 370 Hv, and working except final lapping was done in a state of as cast material. Subsequently, the material was heat-treated at a temperature of 703 K for four hours and allowed to cool to room temperature by air cooling. The hardness after the secondary hardening heat treatment (tempering treatment) at 703 K increased to 550 Hv. The oxidation and thermal deformation of surface plate caused by the secondary hardening heat treatment were minute, and the flatness accuracy of surface plate was kept at 30 $\mu$m by the final surface lapping operation performed subsequently.

Thus, a highly hard lapping surface plate with a hardness of 550 Hv, which cannot be achieved usually for a lapping surface plate with grooves, could be obtained. By using this lapping surface plate, silicon wafers were lapped in the same manner as example 1, with the result that the life of lapping surface plate (number of wafers worked) was about 600,000 sheets, about two times that of the lapping surface plate of example 1.

TABLE 2

| | Cast iron composition (wt %) | | | | | | | |
|---|---|---|---|---|---|---|---|---|
| | C | Si | Mn | Ni | Cr | Mo | Mg | Fe |
| Example 3 | 2.6 | 3.0 | 0.7 | 5.5 | 2.0 | 0.3 | 0.05 | Balance |

As described above, according to the material for lapping tools in accordance with the present invention, a high hardness of 250 Hv or more can be achieved without quenching or rapid cooling treatment etc. Also, coarse hard precipitates are scarcely present, and an excellent structure and uniform hardness can be obtained. Therefore, according to the lapping surface plate of the present invention made of the aforesaid material for lapping tools, the lapping operation of various workpieces can be performed with high accuracy, and the prolonged life and low cost of lapping surface plate can be achieved.

What is claimed is:

1. An Fe-base material for lapping tools, consisting essentially of 0.8 to 3.5 wt % of C, 1 to 7 wt % of Si, 5 to 15wt % of Ni, $0<Mn\leqq$wt %, $0<X\leqq0.1$ wt % where X equals at least one element selected from the group consisting of Mg, Ca and Ce, 2 wt % or less of Cr, 2 wt % or less of at least one element selected from the group consisting of Mo, Nb, Ti, and V, and the balance of the material substantially comprising Fe, wherein said material in the as-cast condition has a matrix of at least 30% by area of martensite, and includes a plurality of spheroidal graphite, and said material having a hardness value of 250 Hv or more.

2. The Fe-base material according to claim 1, wherein the C content of the material ranges from 1.5 to 2.6 wt %.

3. A lapping surface plate consisting of an Fe-base material, said Fe-base material consisting essentially of 0.8 to 3.5 wt % of C, 1 to 7 wt % of Si, 5 to 15 wt % of Ni, $0<Mn\leqq1$ wt %, $0<X\leqq0.1$ wt %, where X equals at least one element selected from the group consisting of Mg, Ca and Ce, 2 wt % or less of Cr, 2 wt % or less of at least one element selected from the group consisting of Mo, Nb, Ti, and V, and the balance comprising Fe, wherein said Fe-base material in the as-cast condition has a matrix of at least 30% by area of martensite and includes a plurality of spheroidal graphite and said Fe-base material having a hardness value of 250 Hv or more.

4. The lapping surface plate according to claim 3, wherein the C content of said Fe-base material ranges from 1.5 to 2.6 wt %.

5. The lapping surface plate according to claim 3, wherein the area of the martensite matrix is 60% or more and the spheroidal graphite has a graphite spheroidization percentage of 70% or more.

6. The Fe-base material according to claim 1, wherein said material has the martensite matrix is 60% or more.

7. The Fe-base material according to claim 1, wherein the spheroidal graphite has a graphite spheroidization percentage of 70% or more.

8. The Fe-base material according to claim 1, wherein the Fe-base material is used in a state as cast.

9. The lapping surface plate according to claim 3 wherein said lapping surface plate is in a state as cast.

10. The lapping surface plate according to claim 9, wherein said lapping surface plate has a diameter of 1.2 to 2.0 m.

11. The lapping surface plate according to claim 3, wherein said lapping surface plate provides lattice-form grooves on a surface thereof and abrasive particle supply holes.

* * * * *

UNITED STATES PATENT AND TRADEMARK OFFICE

CERTIFICATE OF CORRECTION

PATENT NO. : 5,853,504

DATED : December 29, 1998

INVENTOR(S) : Takanobu Nishimura

It is certified that error appears in the above-indentified patent and that said Letters Patent is hereby corrected as shown below:

Claim 1, column 9, line 28, change "15wt" to --15 wt--.

Signed and Sealed this

Second Day of November, 1999

*Attest:*

*Attesting Officer*

Q. TODD DICKINSON

*Acting Commissioner of Patents and Trademarks*